US007584800B2

(12) United States Patent
Heath et al.

(10) Patent No.: US 7,584,800 B2
(45) Date of Patent: Sep. 8, 2009

(54) SYSTEM AND METHOD FOR INDEXING A TOOL IN A WELL

(75) Inventors: Michael Heath, Dickinson, TX (US); Andrew C. Posluszny, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 301 days.

(21) Appl. No.: 11/164,080

(22) Filed: Nov. 9, 2005

(65) Prior Publication Data

US 2007/0102163 A1 May 10, 2007

(51) Int. Cl.
*E21B 34/06* (2006.01)
*E21B 43/12* (2006.01)

(52) U.S. Cl. ..... 166/386; 166/250.01; 166/319; 166/331

(58) Field of Classification Search ..... 166/250.01, 166/386, 319, 331
See application file for complete search history.

(56) References Cited

U.S. PATENT DOCUMENTS 5,033,307 A * 7/1991 Uhri et al. ..... 73/784
6,158,529 A * 12/2000 Dorel ..... 175/61
6,276,458 B1 8/2001 Malone
6,491,102 B2 * 12/2002 Leismer et al. ..... 166/316
6,595,296 B1 * 7/2003 French ..... 166/375
6,782,952 B2 8/2004 Garay
6,889,771 B1 5/2005 Leising
2004/0069491 A1 4/2004 Garay
2005/0039914 A1 2/2005 Purkis
2005/0087344 A1 * 4/2005 Toekje et al. ..... 166/375

FOREIGN PATENT DOCUMENTS

WO 00/04274 A1 1/2000
WO 02/20942 A1 3/2002
WO 00/29708 A2 5/2005

* cited by examiner

*Primary Examiner*—Shane Bomar
(74) *Attorney, Agent, or Firm*—Daryl R. Wright; James L. Kurka; Van Someren, PC

(57) ABSTRACT

A technique is provided to control a downhole tool in a well. An indexer is used to adjust a downhole tool to specific positions on a plurality of positions. The indexer is actuated between settings via control fluid input. The indexer is designed such that a unique amount of control fluid is used for actuation of the indexer to each specific setting.

17 Claims, 4 Drawing Sheets

SYSTEM AND METHOD FOR INDEXING A TOOL IN A WELL

BACKGROUND

Well completion equipment is used in a variety of well related applications involving, for example, the production of fluids. The completion equipment is deployed in a wellbore and often comprises one or more downhole tools that have a plurality of operating positions or settings. For example, downhole chokes may have a plurality of different flow positions.

One way of actuating the downhole tools between positions is to connect the tool to an indexer. Many types of indexers are available to actuate downhole tools from one sequential position to another and to hold the tool at a desired position. The indexer typically has a sleeve with a plurality of slots having different lengths that correspond with different indexer settings and thus different downhole tool positions. The indexer is adjusted from one setting to another by an appropriate force input, such as a hydraulic input, to shift the sleeve from one slot setting to another, as known in the art.

In fluid, e.g. hydraulic, actuated indexers, the quantity of hydraulic control fluid displaced with each move to a different setting is the same. Accordingly, although it may be possible to determine that a move from one setting to another has been achieved, it is difficult for the operator to accurately determine the specific indexer setting and thus the specific downhole tool position.

SUMMARY

In general, the present invention provides a system and method for indexing in a downhole environment. An indexer is provided with a plurality of operating settings that correspond to downhole tool positions when the indexer is coupled to a downhole tool for actuation within a wellbore. The amount of control fluid required to actuate the indexer for each of the plurality of operating settings is unique. In other words, the fluid used to achieve each setting is different from the quantity of fluid required for adjustment to any of the other settings. This enables measurement of the actuating fluid used and accurate determination of the specific setting of the indexer and any connected downhole tool.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to indexers and to well systems having multi-position tools that may be selectively adjusted by an indexer. The system and methodology provide a way of determining when the indexer actuates from one setting to another to move a multi-position tool from one operational position to another. Additionally, feedback is provided to an operator such that the operator is readily able to determine the actual indexer setting and tool position after adjustment of the indexer from one setting to another.

Figure 1:
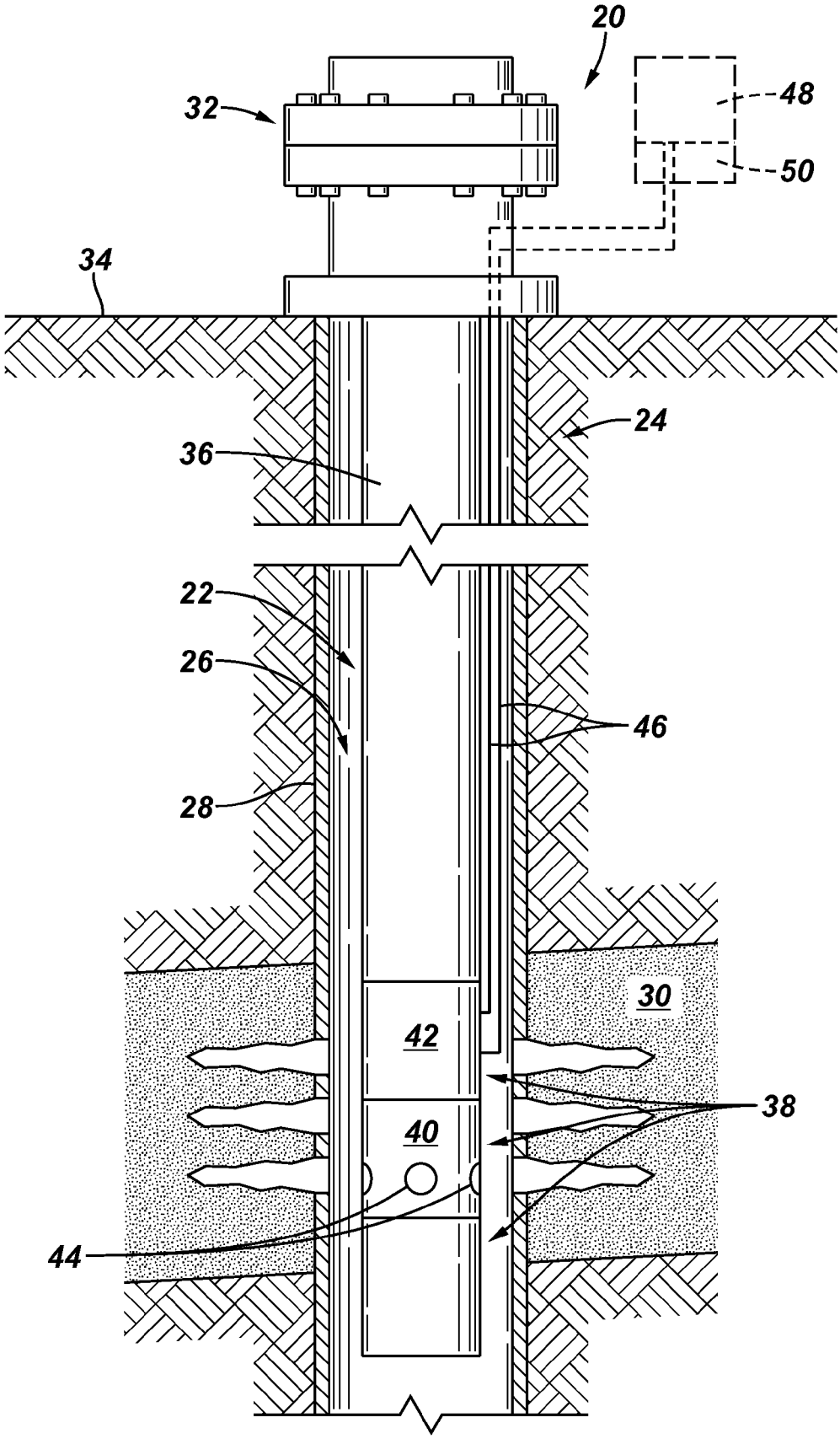
FIG. 1 is a front elevation view of a completion deployed in wellbore, according to an embodiment of the present invention.

Referring generally to FIG. 1, one embodiment of a well system 20 is illustrated as comprising a well completion 22 deployed for use in a well 24 having a wellbore 26. The wellbore may be lined with a wellbore casing 28 having perforations through which fluid is able to flow between a surrounding formation 30 and wellbore 26. Completion 22 is deployed in wellbore 26 below a wellhead 32 disposed at a surface location 34, such as the surface of the Earth or a seabed floor. In many applications, wellbore 26 is formed, e.g. drilled, in formation 30 for access to desirable fluids held by the formation, such as oil or gas.

Completion 22 is located within the interior of casing 28 and comprises a tubing 36 supporting a plurality of completion components 38. In this embodiment, well completion 22 comprises a downhole tool 40 having a plurality of operating positions. Downhole tool 40 is moved from one operating position to another by an indexer 42 operatively coupled to the downhole tool 40, as known to those of ordinary skill in the art. By way of specific example, downhole tool 40 may comprise a choke having a plurality of positions that are selected to control the amount of fluid flow through ports, such as radial ports 44. Indexer 42 is actuated selectively from one indexer setting to another by fluid inputs supplied to indexer 42 via one or more fluid control lines 46. The fluid inputs are initiated by a fluid supply and control system 48 coupled to control line 46 and located at, for example, surface 34. Well system 20 also comprises a volume-recording control system 50 for measuring the amount of fluid supplied to and/or returned from indexer 42. System 50 may comprise a manual system or a computerized control system like the Surface Hydraulic Control System available from Schlumberger Corporation.

Figure 2:
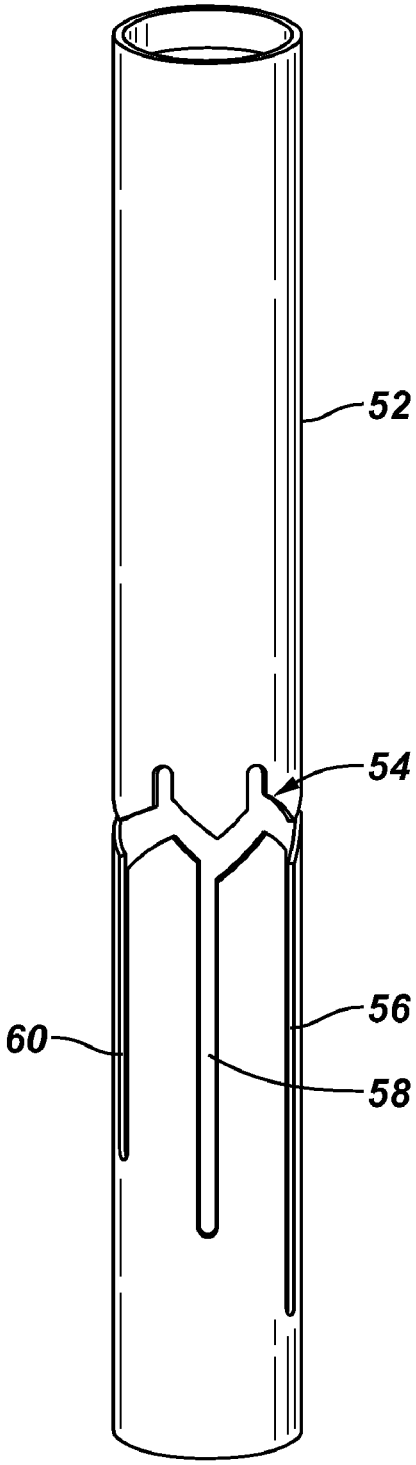
FIG. 2 is an isometric view of a sleeve of the indexer illustrated in FIG. 1, according to an embodiment of the present invention.
Figure 3:
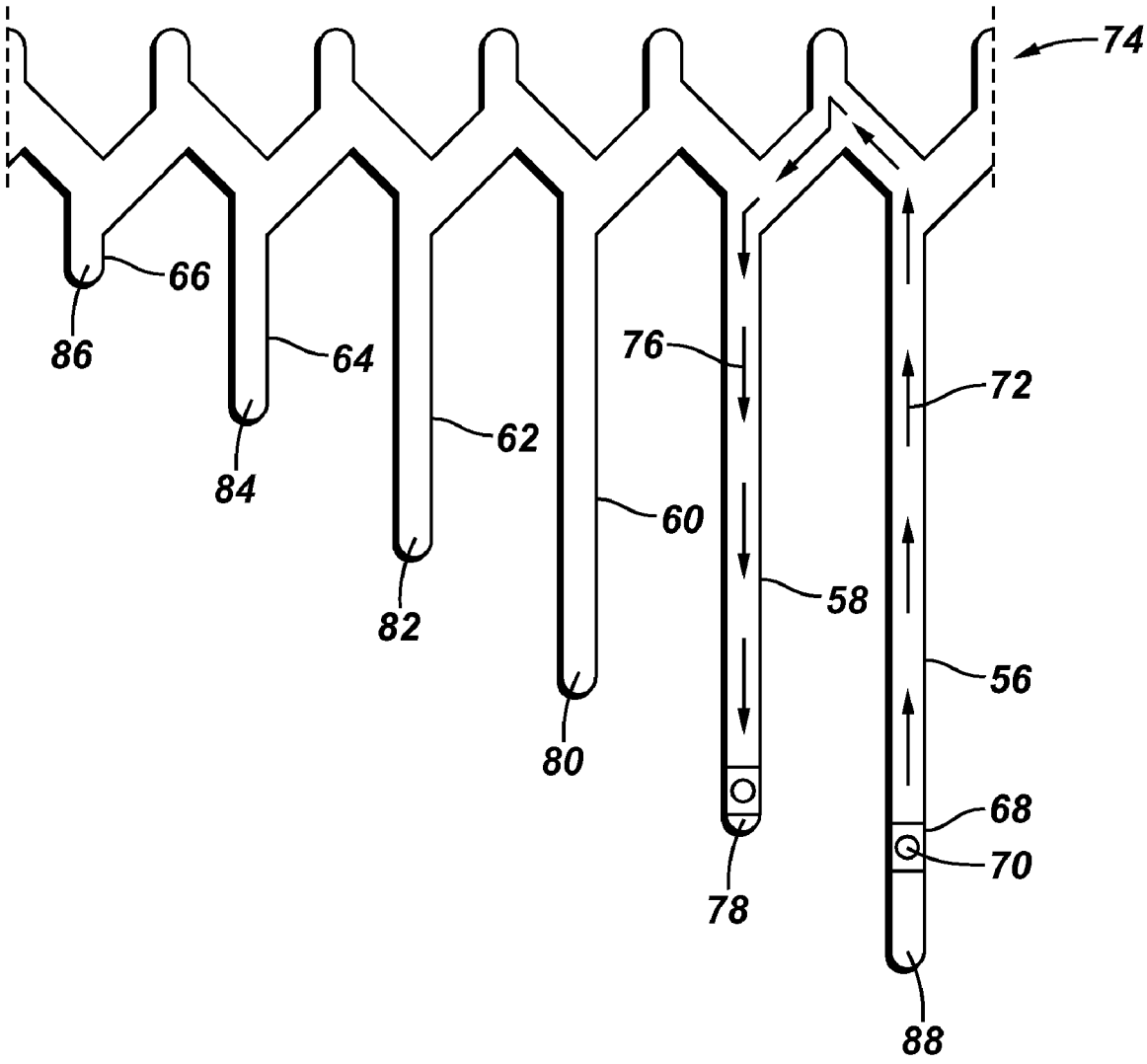
FIG. 3 is a graphical representation of a plurality of indexer settings, according to an embodiment of the present invention.

Referring generally to FIG. 2, an indexer sleeve 52 of indexer 42 is illustrated. The indexer sleeve 52 comprises a track 54 having a plurality of elongated portions that define a plurality of sequential indexer settings. With additional reference to FIG. 3, this particular embodiment has elongated track portions 56, 58, 60, 62, 64 and 66 that each define a unique indexer setting. An indexer positioning mechanism 68, e.g. a tubular indexer housing, undergoes relative movement with respect to indexer sleeve 52 while being constrained to track 54 via a guide member 70 that follows track 54 from one indexer setting to another as sleeve 52 and mechanism 68 undergo relative movement. For example, elongated track portion 56 may represent a closed setting with indexer positioning mechanism 68 and indexer sleeve 52 at a state of greatest relative contraction. Upon appropriate input via fluid control line 46, movement of guide member 70 and indexer positioning mechanism 68 relative to indexer sleeve 52 is forced along a path 72, as represented by arrows in FIG.

3. The guide member 70 is forced to a lateral transfer region 74 of track 54, and guide member 70 is then shifted laterally to elongated track portion 58. The guide member 70 is then returned along a path 76 of elongated track portion 58 to the next sequential indexer setting 78. This process can be repeated to adjust the indexer to each sequential setting 80, 82, 84, 86 and 88. When the indexer 42 is coupled to downhole tool 40, the relative expansion and/or contraction of indexer sleeve 52 relative to indexer positioning mechanism 68 adjusts downhole tool 40 to its corresponding tool positions. For example, if downhole tool 40 comprises a choke having radial ports 44, each indexer setting corresponds to a specific flow position of the choke. In the example illustrated, indexer 42 and downhole tool 40 have six settings/positions, however the indexer and tool may be designed with a greater or lesser number of setting/positions.

As with conventional indexers, actuation of the indexer from one setting to another can be accomplished with fluid input via fluid control line 46. However, the present indexer 42 makes the amount of control fluid displaced in adjusting the indexer to each setting a unique quantity of fluid relative to the quantity of fluid required for actuation to the other indexer settings. The amount of fluid displaced for each indexer setting, and thus for each tool position, can be monitored by, for example, volume-recording control system 50. In this example, the control fluid may comprise a hydraulic fluid.

During actuation of indexer 42 from one setting to the next sequential setting, the amount of fluid supplied during relative indexer component movement along path 72 is greater than the amount of fluid returned during relative indexer component movement along path 76. Accordingly, an operator can determine that the indexer has changed settings, and thus the downhole tool 40 also has successfully changed tool positions. However, the net difference in volume of fluid between the amount of fluid supplied and the amount of fluid returned is unique for each sequential setting. Accordingly, the measured net difference in volume corresponds to a specific sequential change in setting, e.g. a move from the indexer setting 78 to indexer setting 80, a move from indexer setting 80 to indexer setting 82, etc. Based on the unique volume of displaced fluid, e.g. net fluid volume, the well operator is able to determine the exact indexer setting and downhole tool position following transition to each new indexer setting/tool position. Providing a unique amount of fluid displacement that corresponds with each specific indexer setting can be achieved by, for example, forming track 54 such that each pair of adjacent elongated tracks has a difference in length that is unique relative to the difference in length of any of the other pairs of adjacent elongated tracks. For example, the difference in length between elongated tracks 56 and 58 is unique relative to the difference in length between elongated tracks 58 and 60. Accordingly, the net fluid displaced is unique to each new sequential setting, thereby enabling the operator to determine the exact indexer setting and thus the exact position of downhole tool 40. Furthermore, the different track lengths also can be used to provide the operator with positioning information based on the unique volume of displaced fluid for movement along each individual track. This unique volume of displaced fluid can be measured by volume-recording control system 50, enabling the operator to determine the exact indexer and tool setting at each indexer half position that occurs when guide member 70 is forced to lateral transfer region 74.

Figure 4:
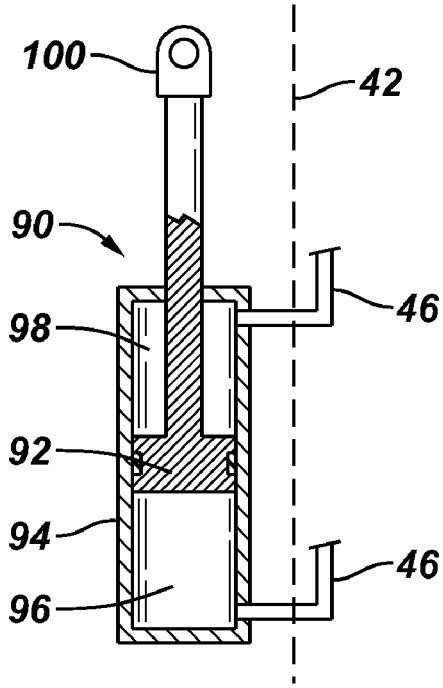
FIG. 4 is a schematic illustration of an actuation system of the indexer illustrated in FIG. 1, according to an embodiment of the present invention.

As with conventional indexers, the actuation of indexer 42 can be achieved by fluid input to a fluid cylinder that forms a part of the indexer. As illustrated schematically in FIG. 4, a double-acting cylinder system 90 may be used to actuate indexer 42. In this embodiment, a movable hydraulic actuation member, such as a piston 92, is slideably mounted within a cylinder 94, and piston 92 is selectively moved along cylinder 94 via hydraulic input through one of the control lines 46. For example, hydraulic fluid input through the lower control line 46 into a cylinder chamber 96 drives piston 92 along the cylinder in a first direction and forces actuation of the indexer 42 along path 72. Subsequently, hydraulic fluid may be input to an upper cylindrical chamber 98 via the upper control line 46 to drive piston 92 in an opposite direction, forcing actuation of indexer 42 along path 76. This provides double-acting control over movement of piston 92. The difference in fluid volume input and returned through the lower control line 46 corresponds with a specific indexer setting. As explained above, however, the unique volume of displaced fluid corresponding with movement along each path also can be used to determine the specific indexer setting. By way of example, the fluid supplied to move up path 72 tells the operator from which position the indexer/tool is moving. Likewise, fluid returned from travel down path 76 tells the operator to which position the indexer/tool is moving.

Of course, the configuration of double-acting cylinder system 90 can vary depending on the size and design of indexer 42. In general, cylinder 94 may be connected to or integrally formed with either indexer sleeve 52 or indexer positioning mechanism 68. Piston 92 is coupled to the other of the indexer sleeve 52 or indexer positioning mechanism 68 via an appropriate connection 100. Accordingly, fluid input into either cylindrical chamber 96 or cylindrical chamber 98 forces controlled relative movement between indexer sleeve 52 and indexer positioning mechanism 68, enabling controlled sequential movement of indexer 42 from one indexer setting to another. This, in turn, controls the adjustment of the downhole choke or other downhole tool 40 from one tool position to another.

Figure 5:
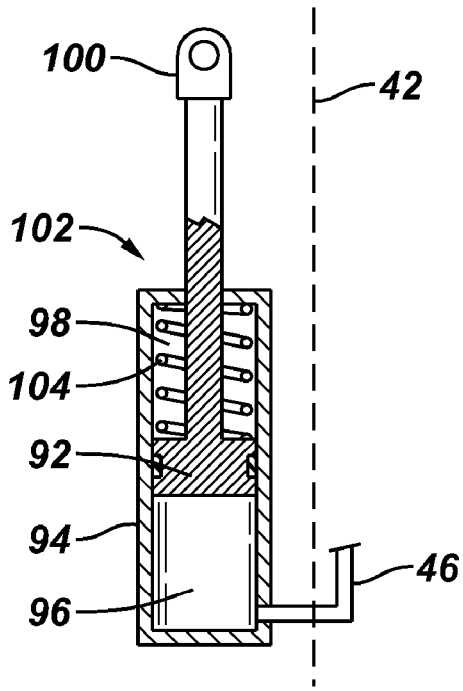
FIG. 5 is a schematic illustration of another embodiment of the actuation system illustrated in FIG. 4.

As illustrated in FIG. 5, an alternate embodiment of indexer 42 incorporates a single-acting cylinder system 102. In this embodiment, chamber 96 of cylinder 94 receives hydraulic input from a single fluid control line 46 to selectively force piston 92 along cylinder 94. This motion, however, is resisted by a spring member 104 which also serves to force piston 92 in an opposite direction once pressure is released from the single control line 46. In either embodiment, the unique volumes of displaced hydraulic fluid used in moving piston 92 and indexer 42 from one indexer setting to another correspond with specific indexer settings, thereby providing feedback to the well operator as to the actual indexer setting and tool position.

Figure 6:
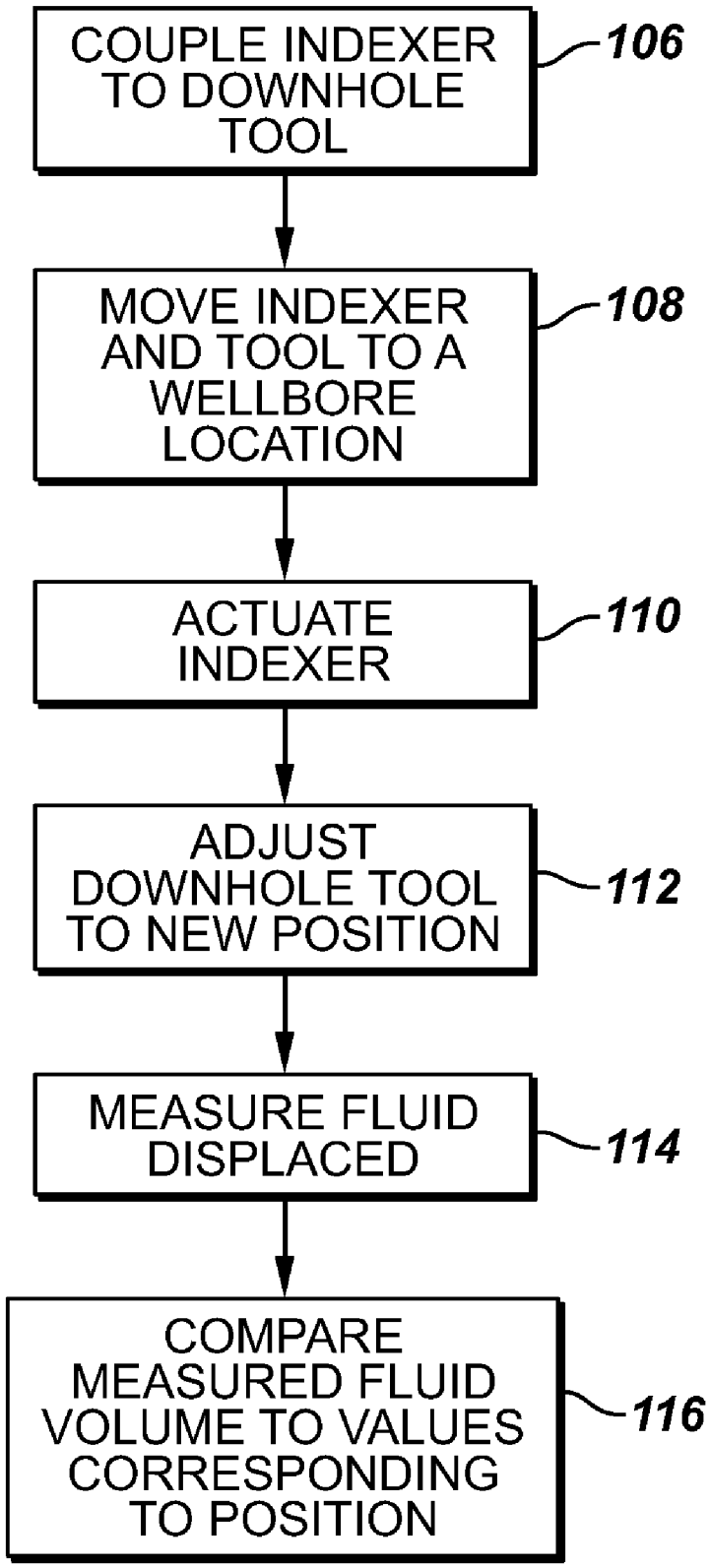
FIG. 6 is a flow chart representing a methodology of utilizing the system illustrated in FIG. 1, according to an embodiment of the present invention.

One embodiment of the methodology for achieving controlled indexing downhole with feedback as to actual tool position is illustrated by the flowchart of FIG. 6. As illustrated, indexer 42 initially is coupled to downhole tool 40, as shown by block 106. In many applications, indexer 42 is coupled to a multiposition choke for controlling fluid flow in the wellbore. The indexer 42 and downhole tool 40 are then moved downhole to a desired wellbore location, as illustrated by block 108. As illustrated in FIG. 1, the indexer and downhole tool may be deployed as part of a completion on tubing 36 for use in the production of hydrocarbon based fluids from formation 30.

Once at the desired wellbore location, the indexer 42 may be actuated to a sequential setting via fluid input provided through fluid control line 46, as illustrated by block 110. The actuation of indexer 42 consequently adjusts downhole tool 40 to a new position, as illustrated by block 112. Upon adjustment of downhole tool 40, the fluid displaced can be measured, as illustrated by block 114. The fluid displaced is then compared to values corresponding with specific indexer settings/tool positions, e.g. indexer settings 78, 80, 82, 84, 86 and 88, to determine the actual indexer setting and downhole tool position, as illustrated by block 116. This fluid measurement can be performed, for example, by volume-recording control system 50.

In this embodiment, the combination of indexer 42, downhole tool 40 and volume-recording control system 50 enable an operator to use fluid pumped down through control line 46 effectively as feedback to distinguish the actual new position of tool 40. Furthermore, the difference in amount of fluid supplied relative to the amount returned verifies to the operator that an adjustment or shift in position has occurred.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A well system, comprising:

a downhole tool having multiple operating positions; and an indexer coupled to the downhole tool to adjust the downhole tool to select positions of the multiple of operating positions, the indexer being actuated via a control fluid, wherein the amount of control fluid required to actuate the indexer between each sequential operating position of the multiple operating positions is different relative to the amount of fluid required to actuate the indexer between the other sequential operating positions to enable monitoring of the operating position of the downhole tool throughout its operating positions.

2. The well system as recited in claim 1, wherein the downhole tool comprises a downhole choke.

3. The well system as recited in claim 1, wherein the control fluid is a hydraulic fluid.

4. The well system as recited in claim 1, further comprising an automated volume-recording control system to automatically measure the amount of control fluid used to actuate the indexer for obtaining a new operating position.

5. The well system as recited in claim 1, wherein the indexer has at least six settings.

6. A method, comprising:

deploying a tool in a wellbore;

actuating the tool to a first tool position and subsequently to a finite plurality of different tool positions via hydraulic input to an indexer coupled to the tool, wherein the indexer comprises a corresponding finite plurality of sequential indexer settings;

shifting the indexer among the finite plurality of sequential indexer settings by cycling a hydraulic pressure input; and determining a specific tool position from the first tool position and the finite plurality of different tool positions by measuring a unique amount of hydraulic fluid required for actuation of the tool to the one of the finite plurality of sequential indexer settings corresponding to the specific tool position.

7. The method as recited in claim 6, wherein deploying comprises deploying a downhole choke.

8. The method as recited in claim 6, wherein actuating comprises supplying hydraulic fluid to a cylinder of the indexer.

9. The method as recited in claim 8, wherein supplying comprises supplying hydraulic fluid to a single-acting cylinder.

10. The method as recited in claim 8, wherein supplying comprises supplying hydraulic fluid to a double-acting cylinder.

11. The method as recited in claim 6, further comprising utilizing an automated volume-recording control system to automatically measure an amount of hydraulic fluid used to actuate the indexer and adjust the tool to the specific tool position.

12. The method as recited in claim 6, wherein determining comprises determining the specific tool position of at least six tool positions.

13. A method, comprising:

utilizing an indexer in a well to adjust a downhole tool to one of a finite plurality of tool positions via hydraulic input to the indexer comprising a corresponding finite plurality of sequential indexer settings in which the indexer is shifted between the finite plurality of sequential indexer settings by cycling the hydraulic input; and determining the specific tool position of the finite plurality of tool positions by measuring a difference in the amount of fluid supplied relative to the amount of fluid returned during shifting of the indexer to one of the plurality of sequential indexer settings corresponding to the specific tool position.

14. The method as recited in claim 13, wherein utilizing comprises utilizing the indexer to control a downhole choke.

15. The method as recited in claim 13, wherein determining comprises measuring an amount of hydraulic fluid required to actuate an indexer positioning mechanism relative to an indexer sleeve as the indexer is shifted between the sequential indexer settings.

16. The method as recited in claim 13, wherein utilizing comprises adjusting the downhole tool to one of at least six positions.

17. The method as recited in claim 13, wherein determining comprises using an automated volume-recording control system to automatically measure an amount of hydraulic fluid used in actuating the indexer to adjust the downhole tool to the specific tool position.

* * * * *